US010293968B2

(12) United States Patent
Hirose

(10) Patent No.: US 10,293,968 B2
(45) Date of Patent: May 21, 2019

(54) BLOW-MOLDED CONTAINER WITH PINCH-OFF PART

(71) Applicant: KURARAY CO., LTD., Kurashiki-shi (JP)

(72) Inventor: Wataru Hirose, Kurashiki (JP)

(73) Assignee: KURARAY CO., LTD., Kurashiki-shi (JP)

( * ) Notice: Subject to any disclaimer, the term of this patent is extended or adjusted under 35 U.S.C. 154(b) by 797 days.

(21) Appl. No.: 14/400,713

(22) PCT Filed: May 8, 2013

(86) PCT No.: PCT/JP2013/062901
§ 371 (c)(1),
(2) Date: Nov. 12, 2014

(87) PCT Pub. No.: WO2013/172226
PCT Pub. Date: Nov. 21, 2013

(65) Prior Publication Data

US 2015/0144523 A1 May 28, 2015

(30) Foreign Application Priority Data

May 14, 2012 (JP) ..... 2012-110160

(51) Int. Cl.
*B65D 1/02* (2006.01)

(52) U.S. Cl.
CPC ..... *B65D 1/0207* (2013.01)

(58) Field of Classification Search
CPC .. C08L 29/04; C08L 23/0815; C08L 23/0861; C08L 51/04; C08L 51/006; C08L 2205/02; Y10T 428/13; Y10T 428/1341; Y10T 428/1352; Y10T 428/139; Y10T 428/1393; B32B 2270/00; B32B 27/306
USPC ..... 428/35.7, 35.8, 35.9, 36.6, 36.7, 36.8; 524/446, 503; 525/56, 58
See application file for complete search history.

(56) References Cited

U.S. PATENT DOCUMENTS

| | | | | |
|---|---|---|---|---|
| 2003/0018114 | A1* | 1/2003 | Tai | B32B 7/02 524/413 |
| 2004/0091653 | A1 | 5/2004 | Tai et al. | |
| 2012/0052225 | A1* | 3/2012 | Kani | C08L 29/04 428/35.4 |
| 2015/0115636 | A1* | 4/2015 | Shiomi | B25J 15/12 294/106 |

FOREIGN PATENT DOCUMENTS

| | | | | |
|---|---|---|---|---|
| EP | 2 436 728 | A1 | 4/2012 | |
| JP | 57-32952 | | 2/1982 | |
| JP | 06-345876 | | 12/1994 | |
| JP | 2001-277341 | | 10/2001 | |
| JP | 2002-241546 | | 8/2002 | |
| JP | 2004-269725 | | 9/2004 | |
| JP | 2005-315367 | A | 11/2005 | |
| JP | 2010-095315 | | 4/2010 | |
| JP | 2011-213373 | | 10/2011 | |
| WO | WO 2010137659 | A1 * | 12/2010 | C08L 23/0861 |

OTHER PUBLICATIONS

Asahi Kasei Corp, Product Information for Tuftec H1041, Apr. 5, 2017, p. 1 https://www.akelastomer.com/eng/products/tuftec/h1041.html.*
Dyson, Robert William. Engineering Polymers. Blackie, 1990, pp. 57 and 58.*
Technical Data Sheet for Tafnner A-4085S, Mitsui Chemicals, available online at https://www.mitsuichem.com/en/special/tafmer/grades/pdf/tds_e_A-4085S.pdf, p. 1 (Year: 2018).*
Extend European Search Report dated Oct. 30, 2015 in Patent Application No. 13791414.9.
International Search Report dated Jun. 25, 2013 in PCT/JP13/062901 Filed May 8, 2013.

* cited by examiner

*Primary Examiner* — Lee E Sanderson
(74) *Attorney, Agent, or Firm* — Oblon, McClelland, Maier & Neustadt, L.L.P.

(57) ABSTRACT

There is provided a blow-molded container having a pinch-off part and having, as an innermost layer, a layer of resin composition comprising an ethylene-vinyl alcohol copolymer (A) and a soft resin (B), characterized in that the soft resin (B) is a thermoplastic styrenic elastomer or α-olefinic polymer; a mass ratio of the ethylene-vinyl alcohol copolymer (A) to the soft resin (B) [(A)/(B)] is within the range of 75/25 to 90/10; the resin composition has a matrix and domain structure in which the ethylene-vinyl alcohol copolymer (A) is a matrix phase and the soft resin (B) is a domain phase; and a surface-to-surface interparticle distance in the domain phase is 0.3 μm or less.

7 Claims, No Drawings

BLOW-MOLDED CONTAINER WITH PINCH-OFF PART

TECHNICAL FIELD

The present invention relates to a blow-molded container having a pinch-off part and having, as an innermost layer, a layer of resin composition comprising an ethylene-vinyl alcohol copolymer.

BACKGROUND ART

An ethylene-vinyl alcohol copolymer (hereinafter, sometimes abbreviated as "EVOH") exhibits excellent barrier properties to a gas such as oxygen and excellent melt moldability. It is, therefore, molded into a film, a bottle or the like, or widely used as various packaging materials. EVOH has lower impact strength due to its high crystallinity, and is, therefore, often used as a laminate with a thermoplastic resin having excellent mechanical properties for compensating for the drawback. In particular, in the field of a blow-molded container or the like, a multilayer structure is extensively employed, which has a layer of resin composition containing EVOH and a layer of polyolefin resin such as polyethylene and polypropylene.

For instance, JP57-32952 A has described a multilayer container produced by multilayer co-extrusion blow molding, which is chemical-resistant and less gas-permeable and in which an EVOH layer is an intermediate layer and the outer and the inner layers are polyolefin layers. However, in the multilayer container, a polyolefin layer as an innermost layer is less resistant to an organic solvent, so that, when a content is an organic solvent or the like, the container may be deteriorated, leading to reduced impact resistance after long-term storage.

Resistance to an organic solvent of a container can be improved by employing an EVOH layer as an innermost layer. However, in a container in which an innermost layer is made of EVOH, a polyolefin layer can be laminated on only one side of the EVOH layer, resulting in insufficient impact resistance, and thus the container may not be used in an application requiring high impact resistance. JP2010-95315 A has thus proposed an agrochemical container having, as an innermost layer, a layer of resin composition containing a polymer having EVOH and polyalkylene ether units. The document has described that the agrochemical container is excellent in impact resistance at a low temperature.

PRIOR ART REFERENCES

Patent References

Patent Reference No. 1: JP57-32952 A
Patent Reference No. 2: JP2010-95315 A

SUMMARY OF THE INVENTION

Problem to be Solved by the Invention

To be resistant to impact such as dropping in actual use of a blow-molded container having a pinch-off part, the blow-molded container requires not only impact strength of the side, the bottom and the edge of the container as evaluated by izod impact strength with notch, but also impact strength in the pinch-off part. In particular, in a blow-molded container in which an EVOH layer is an intermediate layer and the inner and the outer layers are polyolefin layers, a pinch-off part is formed by mutual fusion of the polyolefin forming the innermost layer, while in a blow-molded container in which a resin composition containing EVOH is used as an innermost layer, the pinch-off part is formed by mutual fusion of EVOH. After investigation, we have found that addition of a polymer having polyalkylene ether units to EVOH as described in Japanese published unexamined application No. 2010-95315 can improve impact resistance as evaluated by izod impact strength with notch, but reduces impact strength in the pinch-off part, resulting in insufficient impact resistance as a blow-molded container.

In view of these circumstances, an objective of this invention is to provide a blow-molded container in which a resin composition containing EVOH is used as an innermost layer, and which is excellent in both impact strength in the side, the bottom and the edge and impact strength of the pinch-off part as well as highly resistant to impact such as dropping in actual use.

Means for Solving Problem

To solve the above problems, the present invention provides a blow-molded container having a pinch-off part and having, as an innermost layer, a layer of resin composition comprising an ethylene-vinyl alcohol copolymer (A) and a soft resin (B), characterized in that the soft resin (B) is a thermoplastic styrenic elastomer or α-olefinic polymer; a mass ratio of the ethylene-vinyl alcohol copolymer (A) to the soft resin (B) [ (A)/(B)] is within the range of 75/25 to 90/10; the resin composition has a matrix and domain structure in which the ethylene-vinyl alcohol copolymer (A) is a matrix phase and the soft resin (B) is a domain phase; and a surface-to-surface interparticle distance in the domain phase is 0.3 μm or less.

The layer of resin composition has a matrix and domain structure in which EVOH (A) is a matrix phase and a soft resin (B) is a domain phase. Furthermore, in the structure, the domain phase has a surface-to-surface interparticle distance of 0.3 μm or less, so that energy of applied impact is efficiently dispersed by the soft resin, leading to excellent impact strength in the side, the bottom and the edge of the blow-molded container. Furthermore, the soft resin (B) is a particular resin and EVOH (A) and the soft resin (B) are mixed in a particular proportion, so that both impact strength in the side, the bottom and the edge of the blow-molded container and impact strength in the pinch-off part are achieved.

Preferably, a melt flow rate (MFR) of the resin composition under a load of 2160 g at 210° C. is ⅔ or less of a melt flow rate (MFR) of the ethylene-vinyl alcohol copolymer (A).

Preferably, a hardness of the soft resin (B) as measured by a durometer type A in accordance with ISO 7619 is 90 or less. When the soft resin (B) meets the above conditions, impact energy can be more efficiently dispersed, so that impact strength of the side, the bottom and the edge of the blow-molded container can be further improved.

Preferably, the soft resin (B) is a mixture of an acid-modified soft resin (b1) and an unmodified soft resin (b2). When EVOH (A) and the soft resin (B) react in the course of preparing the resin composition and thus the above conditions are met, impact strength of the side, the bottom and the edge of the blow-molded container can be further improved.

Preferably, a blow-molded container of the present invention is used as a chemical bottle. The chemical bottle exhibits excellent oxygen-gas barrier properties and chemical resistance and has high resistance to impact such as dropping in actual use.

The above chemical is preferably agrochemicals, and a blow-molded container of the present invention is preferably used as an agrochemical bottle. The agrochemical bottle is excellent in oxygen-gas barrier properties and resistance to an organic solvent, and has high resistance to impact such as dropping in actual use.

Effect of the Invention

In accordance with the present invention, there can be provided a blow-molded container in which a resin composition containing EVOH is used as an innermost layer, and which is excellent in both impact strength in the side, the bottom and the edge and impact strength of the pinch-off part as well as highly resistant to impact such as dropping in actual use. The blow-molded container can be suitably used as a chemical bottle, particularly an agrochemical bottle.

MODE FOR CARRYING OUT THE INVENTION

There will be described embodiments of a blow-molded container of the present invention. In the following descriptions, specific materials are sometimes exemplarily mentioned as those performing a particular function, but materials which can be used in the present invention are not limited to these materials. Furthermore, unless otherwise specified, materials illustrated can be used alone or in combination of two or more.

[Resin Composition]

A resin composition used for the innermost layer in a blow-molded container of the present invention contains EVOH (A) and a soft resin (B) in a particular mass ratio. The resin composition can further contain other components.

[EVOH (A)]

EVOH (A) is a copolymer mainly containing ethylene units and vinyl alcohol units. EVOH (A) is prepared by, for example, saponifying a copolymer consisting of ethylene and a vinyl ester using an alkali catalyst and so on. A vinyl ester is typically vinyl acetate, but other aliphatic acid vinyl esters (vinyl propionate, vinyl pivalate and the like) can be employed.

Furthermore, EVOH (A) can contain, for example, a vinylsilane compound as a copolymerization component in 0.0002 to 0.2 mol %. Examples of a vinylsilane compound include vinyltrimethoxysilane, vinyltriethoxysilane, vinyltri (β-methoxy-ethoxy)silane and γ-(meth)acryloxypropylmethoxysilane. Among these, vinyltrimethoxysilane and vinyltriethoxysilane are suitably used. Furthermore, in EVOH (A), other comonomers such as propylene, butyrene, and an unsaturated carboxylic acid or its ester such as (meth)acrylic acid, methyl(meth)acrylate or ethyl(meth) acrylate, and a vinyl pyrrolidone such as N-vinylpyrrolidone can be copolymerized as long as achievement of the objectives of the present invention are not interfered.

A content of ethylene units in EVOH (A) is preferably 20 mol % or more and 60 mol % or less, more preferably 25 mol % or more and 55 mol % or less, further preferably 27 mol % or more and 50 mol % or less. If a content of ethylene units is less than 20 mol %, melt moldability of the resin composition is reduced. In contrast, if a content of ethylene units is more than 60 mol %, gas barrier properties of a blow-molded container obtained are deteriorated.

A saponification degree of EVOH (A) is preferably, but not limited to, 90 mol % or more, more preferably 95 mol % or more, further preferably 99 mol % or more. A saponification degree of EVOH (A) within the above range is preferable in the light of maintaining gas barrier properties of a blow-molded container obtained.

In terms of melt viscosity of EVOH (A), a melt flow rate (MFR) under a load of 2160 g at 210° C. is preferably 1.0 to 100 g/10 min, more preferably 2.0 to 60 g/10 min, further preferably 3.0 to 30 g/10 min. By the use of EVOH (A) having such melt viscosity, for example, melt moldability of the resin composition can be improved.

EVOH (A) can be used alone or in combination of two or more.

[Modified EVOH (A')]

A modified ethylene-vinyl alcohol copolymer (A') produced by modifying EVOH with an epoxy compound (E) (hereinafter, sometimes abbreviated as "modified EVOH (A')") can be used as EVOH (A). A modified EVOH (A') is less crystalline and flexible, so that the blow-molded container is excellent in impact strength of the side, the bottom and the edge.

A modified EVOH (A') is produced by modifying EVOH with an epoxy compound (E); for example, a product produced by reacting hydroxy groups in EVOH with an epoxy compound (E).

Such a modified EVOH (A') can be produced by reacting EVOH with an epoxy compound (E) in an extruder. Here, if EVOH as a starting material contains an excessive amount of alkali metal salt and/or alkaline earth metal salt, a modified EVOH (A') obtained may be stained or, due to reduction in viscosity, melt moldability of a modified EVOH (A') may be reduced. Furthermore, as described later, when the above reaction is performed using a catalyst, an alkali metal salt and/or an alkaline earth metal salt may deactivate the catalyst. It is, therefore, preferable to use a minimum content of alkali metal salt and/or alkaline earth metal salt in EVOH as a starting material.

The epoxy compound (E) is preferably an epoxy compound having one epoxy group in one molecule. The epoxy compound (E) preferably has a molecular weight of 500 or less. A multivalent epoxy compound having two or more epoxy groups in a molecule may cause a crosslinking reaction during its reaction with EVOH.

Preferably, the excessive epoxy compound (E) used in the modification reaction can be easily removed from a modified EVOH (A') obtained. One way of such removal is volatilization of the epoxy compound (E) from a vent of the extruder. A boiling point of the epoxy compound (E) is, therefore, preferably 250° C. or less, more preferably 200° C. or less. A carbon number of the epoxy compound (E) is preferably 2 to 10. Specific examples of such an epoxy compound (E) include epoxyethane, 1,2-epoxypropane, 1,2-epoxybutane, glycidol, 1,2-epoxy-3-butene, 1,2-epoxy-4-pentene, 1,2-epoxy-5-hexene, 1,2-epoxy-4-vinylcyclohexane, allyl glycidyl ether, metharyl glycidyl ether and ethyleneglycolallyl glycidyl ether, preferably 1,2-epoxypropane, 1,2-epoxybutane and allyl glycidyl ether. Furthermore, an alternative removing method is removal by washing with water from a vent of the extruder, and herein, the epoxy compound (E) is preferably water-soluble.

There are no particular restrictions to the conditions of the reaction of EVOH (A) and the epoxy compound (E), and the reaction is preferably conducted in an extruder as described in WO 02/092643. Here, preferably a catalyst is added, and in such a case, preferably a catalyst deactivator such as a carboxylic acid is added after the reaction. Addition of the epoxy compound (E) to a fused EVOH resin in an extruder is preferable because volatilization of the epoxy compound (E) can be prevented and the reaction amount can be easily controlled.

A modified amount of the epoxy compound (E) in the modified EVOH (A') is preferably 0.1 to 10 mol %, more preferably 0.3 to 5 mol %, further preferably 0.5 to 3 mol % based on the total molar number of EVOH monomer units. If a modified amount is less than 0.1 mol %, modification may be ineffective. In contrast, if a modified amount is more than 10 mol %, thermal stability may be deteriorated.

[Soft Resin (B)]

A soft resin (B) can be a thermoplastic styrenic elastomer or an α-olefin copolymer. The use of such a resin as a soft resin (B) can achieve both impact strength of the side, the bottom and the edge of a blow-molded container obtained and impact strength of a pinch-off part. Among these, an α-olefin copolymer is preferably used in the light of excellent flexibility at a low temperature and improvement in impact strength of the side, the bottom and the edge of the blow-molded container at a low temperature.

[Thermoplastic Styrenic Elastomer]

There are no particular restrictions to a thermoplastic styrenic elastomer, and those known in the art can be used. A thermoplastic styrenic elastomer generally has a styrene monomer polymer block (Hb) to be a hard segment and a conjugate diene compound polymer block or a hydrogenated block thereof (Sb) to be a soft segment. The structure of this thermoplastic styrenic elastomer can be a di-block structure represented by Hb-Sb, a tri-block structure represented by Hb-Sb-Hb or Sb-Hb-Sb, a tetra-block structure represented by Hb-Sb-Hb-Sb, or a polyblock structure in which 5 or more of Hb and Sb in total are linearly bonded.

Examples of a styrenic monomer used for the styrene monomer polymer block (Hb) include, but not limited to, styrene and its derivatives. Specific examples include styrenes such as styrene, α-methylstyrene, 2-methylstyrene, 4-methylstyrene, 4-propylstyrene, 4-t-butylstyrene, 4-cyclohexylstyrene, 4-dodecylstyrene, 2-ethyl-4-benzylstyrene, 4-(phenylbutyl)styrene, 2,4,6-trimethylstyrene, monofluorostyrene, difluorostyrene, monochlorostyrene, dichlorostyrene, methoxystyrene and t-butoxystyrene; vinyl-containing aromatic compounds including vinylnaphthalenes such as 1-vinylnaphthalene and 2-vinylnaphthalene; and vinylene-containing aromatic compounds such as indene and acenaphthylene. Among these, styrene is preferable. Styrenic monomers can be used alone or in combination of two or more.

There are also no particular restrictions to a conjugated diene compound used for the conjugated diene compound polymer block (Sb). Examples of such a conjugated diene compound include butadiene, isoprene, 2,3-dimethylbutadiene and pentadiene and hexadinene. Among these, butadiene is preferable. Conjugated diene compounds can be used alone or in combination of two or more. Furthermore, it can be copolymerized with another comonomer such as ethylene, propylene, butyrene and styrene. A conjugated diene compound polymer block (b2) can be a hydrogenated product produced by partial or full hydrogenation.

A content of styrene monomer polymer block units (Hb) in a thermoplastic styrenic elastomer is generally 5% by mass or more and 80% by mass or less. In the light of improvement in impact strength of the side, the bottom and the edge of the blow-molded container, it is preferably 10% by mass or more and 50% by mass or less, more preferably 20% by mass or more and 40% by mass or less.

A content of a conjugated diene compound polymer block and/or its hydrogenated block (Sb) in a thermoplastic styrenic elastomer is generally 20% by mass or more and 95% by mass or less. In the light of improvement in impact strength of the side, the bottom and the edge of the blow-molded container, it is preferably 50% by mass or more and 90% by mass or less, more preferably 60% by mass or more and 80% by mass or less.

Specific examples of a thermoplastic styrenic elastomer include styrene-isoprene diblock copolymer (SI), styrene-butadiene diblock copolymer (SB), styrene-isoprene-styrene triblock copolymer (SIS), styrene-butadiene/isoprene-styrene triblock copolymer (SB/IS), and styrene-butadiene-styrene triblock copolymer (SBS) as well as hydrogenated products thereof. Particularly, in the light of higher weather resistance, preferred are hydrogenated styrene-isoprene diblock copolymer (SEP), hydrogenated styrene-butadiene diblock copolymer (SEB), hydrogenated styrene-isoprene-styrene triblock copolymer (SEPS), hydrogenated styrene-butadiene/isoprene-styrene triblock copolymer (SEEPS) and hydrogenated styrene-butadiene-styrene triblock copolymer (SEBS). In the light of improvement in impact strength of the side, the bottom and the edge of the blow-molded container, particularly preferred is hydrogenated styrene-butadiene-styrene triblock copolymer (SEBS).

(α-Olefin Copolymer)

Examples of an α-olefin copolymer include, but not limited to, ethylene-propylene copolymer (EP), ethylene-butene copolymer (EB), propylene-butyrene copolymer (PB) and butyrene-ethylene copolymer (BE). Among these, in the light of high flexibility and improvement in impact strength of the side, the bottom and the edge of the blow-molded container, ethylene-propylene copolymer (EP) and ethylene-butene copolymer (EB), and in the light of improvement in impact strength of the pinch-off part of the blow-molded container, ethylene-butene copolymer (EB) are particularly preferable.

A soft resin (B) used in the present invention is preferably a mixture of an acid-modified soft resin (b1) and an unmodified soft resin (b2) in the light of further improvement in melt moldability and impact strength of the side, the bottom and the edge of the blow-molded container.

An acid-modified soft resin (b1) used in the present invention is produced by acid-modifying the thermoplastic styrenic elastomer or the α-olefin copolymer.

Herein, acid-modification is conducted by copolymerizing, partly substituting α,β-unsaturated carboxylic acid or its anhydride monomers for monomers constituting an α-olefin copolymer or thermoplastic styrenic elastomer, or alternatively introducing an α,β-unsaturated carboxylic acid or its anhydride to some side chains by, for example, graft reaction such as radical addition.

Examples of an α,β-unsaturated carboxylic acid or its anhydride used in the above acid-modification include maleic acid, acrylic acid, itaconic acid, crotonic acid, maleic anhydride and itaconic anhydride. Among these, maleic anhydride can be suitably used.

An acid value of an acid-modified soft resin (b1) is preferably 50 mg KOH/g or less, more preferably 1 mg KOH/g or more and 30 mg KOH/g or less, further preferably 2 mg KOH/g or more and 20 mg KOH/g or less. If an acid value is higher than the range, reaction points with hydroxyl groups in EVOH (A) are so increased that high polymers are formed in the course of melt kneading, leading to tendency to deterioration in melt moldability and thermal stability during blow molding. In contrast, if an acid value is lower than the range, compatibility with EVOH (A) is reduced, which may lead to insufficient impact resistance.

In terms of melt viscosity of a soft resin (B), an MFR under a load of 2160 g at 210° C. is preferably 1.0 to 100 g/10 min, more preferably 2.0 to 60 g/10 min. The use of a soft resin (B) having such melt viscosity can further improve melt moldability during blow molding and impact strength of the side, the bottom and the edge of the blow-molded container.

A difference in an MFR under a load of 2160 g at 210° C. between EVOH (A) and a soft resin (B) is preferably 30 g/10 min or less, more preferably 10 g/10 min or less. Thus, as melt viscosity of EVOH (A) is closer to melt viscosity of the soft resin (B), melt kneading is easier and fine dispersion of the soft resin (B) in EVOH (A) is kept. The use of such a resin composition containing EVOH (A) and a soft resin (B) allows for a blow-molded container which is excellent in impact strength of the side, the bottom and the edge.

A durometer type A hardness measured in accordance with ISO 7619 of a soft resin (B) used for the present invention is preferably 90 or less, more preferably 86 or less, further preferably 70 or less, particularly preferably 67 or less in the light of improvement in impact energy dispersion effect in a resin composition and further improvement in impact strength of the side, the bottom and the edge of the blow-molded container.

[Blend Ratio]

In a resin composition used in the present invention, a mass ratio of EVOH (A) to the soft resin (B) [(A)/(B)] must be 75/25 to 90/10 for achieving both impact strength of the side, the bottom and the edge of the blow-molded container and impact strength of the pinch-off part. If a content of EVOH (A) is lower than the range, impact strength of the pinch-off part is reduced. A mass ratio [(A)/(B)] is preferably 80/20 or more. In contrast, if a content of EVOH (A) is higher than the range, impact strength of the side, the bottom and the edge of a blow-molded container obtained is reduced. A mass ratio [(A)/(B)] is preferably 85/15 or less.

In the above resin composition, the soft resin (B) can be an acid-modified soft resin (b1) alone or preferably a mixture of an acid-modified soft resin (b1) and an unmodified soft resin (b2). When it is used as a mixture, a mass ratio of an acid-modified soft resin (b1) to an unmodified soft resin (b2) [(b1)/(b2)] is preferably 1/99 to 99/1 in the light of improving impact strength of the side, the bottom and the edge of the blow-molded container. If a content of an acid-modified soft resin (b1) is higher than the range, melt moldability of the resin composition is reduced, causing increased fish eyes during blow molding. Furthermore, the fish eyes can be starting point of breaking of a blow-molded container. A mass ratio [(b1)/(b2)] is more preferably 67/33 or less, further preferably 50/50 or less. If a content of an acid-modified soft resin (b1) is lower than the range, compatibility of EVOH (A) and a soft resin (B) is insufficient, so that a finely dispersed matrix and domain structure cannot be obtained and impact strength of the side, the bottom and the edge of a blow-molded container produced is reduced. A mass ratio [(b1)/(b2)] is more preferably 10/90 or more, further preferably 25/75 or more, particularly preferably 30/70 or more.

It is believed that in the resin composition, the acid-modified soft resin (b1) used as a soft resin (B) is highly compatible with EVOH (A) and acts as a compatibilizer to EVOH (A) and an unmodified soft resin (b2). When the resin composition is prepared by kneading by a twin screw extruder, an acid contained in the acid-modified soft resin (b1) reacts with a hydroxy group in EVOH (A) to forma graft polymer of EVOH (A) and the acid-modified soft resin (b1) in the extruder. This graft polymer is compatible with EVOH (A) and furthermore compatibilizes EVOH (A) with the unmodified soft resin (b2). Thus, the soft resin (B) is finely dispersed in EVOH (A), and impact strength of the side, the bottom and the edge of the blow-molded container is improved.

Formation of a graft polymer leads to increase in entanglement of molecular chains, so that an MFR of the resin composition tends to decrease in comparison with an MFR of EVOH (A) as a base. In the light of sufficient compatibilization effect and good dispersibility of the soft resin (B) in EVOH (A), an MFR of the resin composition is ⅔ or less of an MFR of EVOH (A). An MFR of the resin composition is more preferably 1/10 or more and ⅗ or less, further preferably ⅕ or more and ½ or less of an MFR of EVOH (A). If an MFR of the resin composition is lower than the range, melt moldability of the resin composition is reduced, causing increased fish eyes during blow molding. In contrast, if an MFR of the resin composition is higher than the range, formation of a graft polymer is insufficient, where a finely dispersed matrix and domain structure cannot be obtained and impact strength of the side, the bottom and the edge of the blow-molded container may be reduced.

The resin composition containing EVOH (A) and the soft resin (B) in a mass ratio as described above keeps melt moldability which EVOH originally has. Specifically, a melt flow rate (MFR) of the resin composition under 2160 g at 210° C. is preferably 0.3 to 100 g/10 min, more preferably 0.5 to 60 g/10 min, further preferably 1.0 to 30 g/10 min. When an MFR as the resin composition is within the above range, a blow-molded container with good appearance which is free from any troubles during the melt molding process can be obtained.

[Surface-to-Surface Interparticle Distance]

A resin composition used in the present invention has a matrix and domain structure where EVOH (A) is a matrix phase and a soft resin (B) is a domain phase. Such a matrix and domain structure allows for achieving impact strength of the side, the bottom and the edge of a blow-molded container obtained and impact strength of a pinch-off part.

A surface-to-surface interparticle distance of the soft resin (B) in the resin composition must be 0.30 μm or less for achieving impact strength of the side, the bottom and the edge of the blow-molded container. A surface-to-surface interparticle distance is preferably 0.20 μm or less, more preferably 0.15 μm or less. If a surface-to-surface interparticle distance is more than 0.30 μm, impact resistance is insufficient. A surface-to-surface interparticle distance can be controlled by, for example, adjusting a blend ratio of EVOH (A) and a soft resin (B) or a blend ratio of an acid-modified soft resin (b1) and an unmodified soft resin (b2) in the soft resin (B).

In the resin composition, a surface-to-surface interparticle distance "d" for dispersed particles of the soft resin (B) in EVOH (A) is calculated from a blend ratio of EVOH (A) and the soft resin (B) and a size of the dispersed particles of the soft resin (B) by the following equation.

[Mathematical Formula 1]

$$d = r\left\{\left(\frac{4\pi\sqrt{2}}{3V}\right)^{1/3} - 2\right\} \quad \text{(I)}$$

In equation (I), r is a radius of dispersed particles of the soft resin (B) and V is a volume fraction of the soft resin (B).

A radius of the dispersed particles can be determined by immersing a layer of resin composition obtained in a solvent such as xylene in which the soft resin (B) is soluble, to dissolve the soft resin (B), which is then observed by, for example, scanning electron microscopy to give an image with a magnification ratio of 3000. A radius of the dispersed particles is determined from a diameter of the dispersed particles as directly measured from the image using a ruler or the like or calculating after image processing.

[Other Components]

The resin composition preferably contains a compound such as an acid and a metal in the light of thermal stability and adjustment of viscosity. Examples of this compound include alkali metal salts, carboxylic acid, phosphoric acid compounds and boron compounds, and specific examples are as follows. Here, these compounds can be used as a premix with EVOH (A).

Alkali metal salts: sodium acetate, potassium acetate, sodium phosphate, lithium phosphate, sodium stearate, potassium stearate, sodium ethylenediamine tetraacetate and the like;

Carboxylic acids: oxalic acid, succinic acid, benzoic acid, citric acid, acetic acid, lactic acid and the like;

Phosphoric acid compounds: various acids such as phosphiric acid and phosphorous acid, their salts, and the like;

Boron compounds: boric acids, boric acid esters, boric acid salts, borohydrates and the like.

The resin composition can contain, if necessary, various additives other than those described above. Examples of such additives include antioxidants, plasticizers, thermal stabilizers, ultraviolet absorbing agents, antistatic agents, lubricants, colorants, fillers and other polymer compounds, and these can be blended as long as effects of the present invention are not impaired. Specific examples of the additives include;

Antioxidants: 2,5-di-t-butylhydroquinone, 2,6-di-t-butyl-p-cresol, 4,4'-thiobis-(6-t-butylphenol), 2,2'-methylene-bis-(4-methyl-6-t-butylphenol), octadecyl-3-(3',5'-di-t-butyl-4'-hydroxyphenyl) propionate, 4,4'-thiobis-(6-t-butylphenol) and the like;

Plasticizers: diethyl phthalate, dibutyl phthalate, dioctyl phthalate, wax, liquid paraffin, phosphoric acid esters and the like;

Ultraviolet absorbing agents: ethylene-2-cyano-3,3'-diphenyl acrylate, 2-(2'-hydroxy-5'-methylphenyl)benzotriazole, 2-(2'-hydroxy-5'-methylphenyl)benzotriazole, 2-(2'-hydroxy-5'-methylphenyl)benzotriazole, 2-(2'-hydroxy-3'-t-butyl-5'-methylphenyl)5-chlorobenzotriazole, 2-hydroxy-4-methoxybenzophenone, 2,2'-dihydroxy-4-methoxybenzophenone and the like;

Antistatic agents: pentaerythritol monostearate, sorbitan monopalmitate, sulfated polyolefins, polyethylene oxides and the like;

Lubricants: ethylenebis(stearic acid amide), butyl stearate and the like.

The resin composition can contain, in addition to EVOH (A) and a soft resin (B), a thermoplastic resin and a thermosetting resin as long as the objectives of the present invention are not impaired. Examples of a thermoplastic resin include polyolefins, polyamides, polyvinyl chloride, polyvinylidene chloride, polyesters and polystyrene. Examples of a thermosetting resin include epoxy resins, acrylic resins, urethane resins, polyester resins, and modified products of these resins, which are used alone or as a mixture. When the resin composition contains other resins in addition to EVOH (A) and the soft resin (B), a mixing rate is preferably 50% by mass or less, more preferably 10% by mass or less.

[Preparation of a Resin Composition]

The resin composition can be prepared by, but not limited to, dry-blending EVOH (A) (or a resin containing EVOH as a main component, the same shall apply hereinafter) and a soft resin (B) and then melt-kneading them, or alternatively by mixing a part of EVOH (A) with the soft resin (B) in a high concentration to prepare a master batch, which is then dry-blended with the remaining EVOH (A) and then melt-kneaded. Among these, a process where EVOH (A) and a soft resin (B) are dry-blended and then melt-kneaded is preferable because individual components can be homogeneously blended. When the soft resin (B) is a mixture of an acid-modified soft resin (b1) and an unmodified soft resin (b2), the soft resin (B) added to EVOH (A) can be a dry blend of the acid-modified soft resin (b1) and the unmodified soft resin (b2), or a pellet produced by granulating a melt-kneaded mixture of the acid-modified soft resin (b1) and the unmodified soft resin (b2). The resin composition can be prepared particularly preferably by dry-blending EVOH (A), the acid-modified soft resin (b1) and the unmodified soft resin (b2), which is then melt-kneaded.

Examples of means for melt kneading for preparing the resin composition include, but not limited to, a ribbon blender, a high-speed mixer-cokneader, a mixing roll, an extruder (single-screw or twin-screw extruder) and an intensive mixer. Among these, a method using a single-screw or twin-screw extruder is preferable. A temperature of melt kneading is appropriately selected, depending on the type of a resin used, a molecular weight, a mixing rate of the composition, the type of an extruder and the like, and it is generally within the range of 170 to 350° C.

When melt kneading is conducted using an extruder, preferably an extruder with high kneading degree is used, a hopper port is nitrogen-sealed and extrusion is conducted at a low temperature. Thus, dispersion can be homogeneous, so that gelling or generation and contamination of foreign materials can be prevented.

[Blow-Molded Container]

A blow-molded container of the present invention has the layer of resin composition as an innermost layer, so that the container maintains oxygen gas barrier properties and resistance to an organic solvent which EVOH (A) originally has; is excellent in impact strength of the side, the bottom and the edge and impact strength of the pinch-off part; and is highly resistant to impact such as dropping in actual use.

A blow-molded container of the present invention can be produced by co-extrusion blow molding. A co-extrusion blow molding method is a so-called direct blow molding where using a multilayer extruder having at least two extruders, the above resin composition, another thermoplastic resin and, if necessary, an adhesive resin are supplied to separate extruders and separately kneaded and melt-extruded; these layers are extruded such that the layers converge inside of a die for forming a multilayer parison or outside just after discharge from the die to give a tubular multilayer parison; and then blow-molding the parison in a melt state to form a multilayer container. In other words, a blow-molded container having a pinch-off part of the present invention is a direct blow-molded container. In blow molding in the direct blow molding method molding, a parison is sandwiched by a pair of blow molds and while the parison is cut, the opposite cut part is fused, to form a pinch-off part. An extrusion temperature during blow molding can be appropriately selected, depending on the type of a resin used, a molecular weight, a mixing rate of the composition, the type of an extruder and the like, and is generally within the range of 170 to 350° C.

In terms of layer structure, a blow-molded container of the present invention has a multilayer structure where two or more layers at least containing the layer of resin composition are laminated in the light of mechanical strength. The above layer of resin composition is used as the innermost layer in the container, that is, a layer with which the content in the container is in contact, for preventing the container to be swollen with the content. It is preferable that there is a thermoplastic layer other than EVOH as a layer outer than the innermost layer with which the content is in contact.

In terms of a specific layer structure of the blow-molded container, the following layer structure can be shown by way of example, where E represents a layer obtained from the resin composition, Ad represents a layer obtained from an adhesive resin, and T represents a layer obtained from a thermoplastic resin other than EVOH. The left side is an inner layer. Here, Ad is suitably a carboxylic-acid-modified polyolefin, particularly a maleic-anhydride-modified polyolefin. T can be selected from homopolymers or copolymers of an olefin such as linear low-density polyethylene, low-density polyethylene, medium-density polyethylene, high-density polyethylene, ethylene-vinyl acetate copolymer, ethylene-propylene copolymer, polypropylene, propylene-α-olefin copolymer (α-olefin having 4 to 20 carbon atoms), polybutene and polypentene; polyesters such as polyethylene terephthalate; polyester elastomers; polyamide resins such as Nylon-6 and Nylon-6,6; polystyrene; polyvinyl chloride; polyvinylidene chloride; acrylic resins; vinyl ester resins; polyurethane elastomers; polycarbonates; chlorinated polyethylene; and chlorinated polypropylene. High-density polyethylene and polypropylene are suitably used.

Two layer structure: E/Ad

Three layer structure: E/Ad/T, E/Ad/E

Four layer structure: E/Ad/E/Ad

Five layer structure: E/Ad/T/Ad/E, E/Ad/E/Ad/T

A thickness of each layer in the blow-molded container varies depending on a layer structure, an application, required physical properties and the like, but for example, can be as follows. The values below are the sum of thicknesses of the same type layers when there are two or more of at least one type of the layer of resin composition, the adhesive resin layer and another thermoplastic resin layer.

A thickness of the layer of resin composition is 10 μm or more and 500 μm or less, preferably 20 μm or more and 300 μm or less, more preferably 50 μm or more and 200 μm or less. If the layer of resin composition is too thin, effects of the present invention tend to be unachievable. If the layer of resin composition is too thick, melt moldability tends to be too low. A thickness of another thermoplastic resin layer is 100 μm or more and 6000 μm or less, preferably 200 μm or more and 4000 μm or less, more preferably 300 μm or more and 2000 μm or less. If another thermoplastic resin is too thin, impact strength of the side, the bottom and the edge of the blow-molded container tends to be reduced. If another thermoplastic resin layer is too thick, melt moldability tends to be reduced. A thickness of the adhesive resin layer is generally 2 μm or more and 250 μm or less, preferably 5 μm or more and 150 μm or less, more preferably 10 μm or more and 100 μm or less.

In the blow-molded container, a recovery layer containing scraps having a multilayer structure formed during blow molding can be substituted for the thermoplastic resin layer and/or the adhesive resin layer. Furthermore, scraps of another polyolefin molded product can be mixed.

[Chemical Bottle]

A blow-molded container of the present invention is preferably used as a chemical bottle. The chemical bottle is a bottle for storing a liquid chemical. A blow-molded container of the present invention is not only excellent in impact strength of the side, the bottom and the edge, but also excellent in impact strength of the pinch-off part, and is thus highly resistant to impact such as dropping in actual use. It is, therefore, useful as a chemical bottle or an agrochemical bottle. Here, a liquid chemical indicates an agrochemical such as a solution, a dispersion and a suspension containing various organic chemicals and an aromatic hydrocarbon such as toluene and xylene. Examples of an agrochemical include emulsions containing, for example, an organophosphorous or pyrethroid compound.

The chemical bottle exhibits excellent low-temperature impact resistance effect in a drop impact test (dropping from the height of 1.2 m at −18° C.) in accordance with UN specifications as a standard test for an agrochemical bottle. A chemical container of the present invention has a volume of 0.1 to 100 L; specifically, preferably 0.5 to 50 L, more preferably 1 to 25 L.

[Impact Strength]

In the present invention, impact strength of the side, the bottom and the edge of the blow-molded container and impact strength of the pinch-off part are significantly influenced by physical properties of the resin composition used for the innermost layer. Thus, in the examples below, izod impact strength with notch at 23° C. and −20° C. for an injection-molded article produced by injection molding of the above resin composition is evaluated as an indicator for impact strength of the side, the bottom and the edge of the blow-molded container. A pinch-off part is apart where a parison in blow molding is adhered in a melt state. It is, therefore, influenced by adhesion strength between resins during melting. Thus, in the examples below, a weld part is formed in the center of an injection-molded article during injection molding of the above resin composition, and pinch-off strength is evaluated by izod impact strength for the weld part of the injection-molded obtained.

EXAMPLES

There will be further described the present invention with reference to Examples. However, the present invention is not limited by these examples in any way. Resin compositions obtained and the like were evaluated as described below.

[Content of Ethylene Units and Saponification Degree in EVOH (A)]

A content of ethylene units and a saponification degree in EVOH (A) were determined by $^1$H-NMR measurement (using "JNM-GX-500 type", JEOL Ltd.) using DMSO-$d_6$ as a solvent.

[Melt Viscosity (MFR)]

An outlet velocity (g/10 min) for a sample was measured under the conditions of temperature of 210° C. and a load of 2160 g using a melt indexer ("L244" from Takara Inc.) to determine a melt flow rate (MFR).

[Durometer Hardness]

A durometer type A hardness of a sample was measured using a durometer hardness tester in accordance with ISO 7619.

[Acid Value of Acid-Modified Soft Resin (b1)]

An acid-modified soft resin (b1) was dissolved in xylene, to which using phenolphthalein as an indicator, a 0.05 mol/L potassium hydroxide-ethanol solution was added dropwise, to calculate an acid value.

[Diameter of Dispersed Particles and Surface-to-Surface Interparticle Distance]

A part near the center of an injection-molded article obtained in any of Examples and Comparative Examples was cut using a microtome to expose the cross-section, which was then immersed in xylene at 120° C. for several seconds to elute a soft resin (B). Then, the sample was observed for a dispersion state with a magnification ratio of 3000 using a scanning electron microscope (SEM) (scanning electron microscope "S-2250N" from Hitachi High-Technologies Corporation). Then, from an SEM image taken at a magnification ratio of 3000, a diameter of dispersed particles was estimated using an image analysis software "Image-Pro Plus J" (Media Cybernetics, Inc.). A surface-to-surface interparticle distance d was calculated from the following equation.

[Mathematical Formula 2]

$$d = r\left\{\left(\frac{4\pi\sqrt{2}}{3V}\right)^{1/3} - 2\right\} \quad \text{(I)}$$

In equation (I), r is a radius of dispersed particles of the soft resin (B) and V is a volume fraction of the soft resin (B).

[Izod Impact Strength]

An injection-molded article (80×10×4 mm) obtained in any of Examples and Comparative Examples was notched and determined for izod impact strength under the conditions of 23° C./50% RH and −20° C. using a digital impact tester (Toyo Seiki Kogyo Co., Ltd.) in accordance with JIS K7110.

[Weld Strength]

An injection-molded article (80×10×4 mm) having a weld line in its center was hit by a pendulum such that destruction occurred from the weld line, and the izod impact strength (weld strength) was determined under the conditions of 23° C. and 50% RH using a digital impact tester (Toyo Seiki Kogyo Co., Ltd.).

Example 1

80 parts by mass of EVOH (A1) ("EVAL F171" from Kuraray Co., Ltd.) as EVOH (A), 10 parts by mass of MAh-EB(b1-1)(maleic-anhydride-modified ethylene-butene copolymer) ("Tafmer MH7010" from Mitsui Chemicals, Inc.) and 10 parts by mass of EB(b2-1) (ethylene-butene copolymer) ("Tafmer A4050" from Mitsui Chemicals, Inc.) as a soft resin (B) were dry blended, and the mixture was melt-kneaded using a twin-screw extruder under the melt kneading conditions below, granulated and dried at 80° C. for 6 hours using a hot-air dryer, to give a resin composition (1). Next, the resin composition (1) was molded under the injection molding conditions below using an injection molding machine, to produce an injection-molded article with a size of 80×10×4 mm. Furthermore, using an alternate mold, the composition was molded with two gates being formed to produce an injection-molded article having a weld line in its center with a size of 80×10×4 mm.

[Melt Kneading Conditions]

Apparatus: 26 mmϕ twin-screw extruder ("Labo Plastomill 15C300" from Toyo Seiki Kogyo Co., Ltd.)

L/D: 25

Screw: equi-directional complete meshing type

Die hole number: two holes (3 mmϕ)

Extrusion temperature: feeding unit/compression unit/weighing unit/die=200° C./230° C./230° C./230° C.

Screw Revolution: 100 rpm

Discharge rate: about 5 kg/hr

Drying: hot-air drying at 80° C. for 6 hours

[Injection Molding Conditions]

Apparatus: injection molding machine ("FS-80S 12AS" from Nissei Plastic Industrial Co., Ltd.)

Cylinder temperature: rear/middle/front/nozzle=200° C./220° C./220° C./200° C.

Mold temperature: 60° C.

An MFR of the resin composition (1) as well as a dispersed particle diameter, a surface-to-surface interparticle distance, izod impact strength and weld strength of the injection-molded article produced were evaluated as described above. The injection-molded article produced had a matrix and domain structure where EVOH (A) is a matrix phase and the soft resin (B) is a domain phase. Physical properties of the resins used were shown in Tables 1 and 2 and the evaluation results were shown in Table 3.

Example 2

A resin composition (2) was prepared as described in Example 1, except that EVOH (A2) ("EVAL L171" from Kuraray Co., Ltd.) was used as EVOH (A). Next, an injection-molded article with a size of 80×10×4 mm and an injection-molded article having a weld line in its center with a size of 80×10×4 mm were produced using an injection molding machine as described in Example 1.

An MFR of the resin composition (2) as well as a dispersed particle diameter, a surface-to-surface interparticle distance, izod impact strength and weld strength of the injection-molded article produced were evaluated as described above. The injection-molded article produced had a matrix and domain structure where EVOH (A) is a matrix phase and the soft resin (B) is a domain phase. Physical properties of the resins used were shown in Tables 1 and 2 and the evaluation results were shown in Table 3.

Example 3

A resin composition (3) was prepared as described in Example 1, except that 80 parts by mass of EVOH (A1) was used as EVOH (A) and 20 parts by mass of MAh-EB (b1-2) ("Tafmer MA8510" from Mitsui Chemicals, Inc.) was used as a soft resin (B). Next, an injection-molded article with a size of 80×10×4 mm and an injection-molded article having a weld line in its center with a size of 80×10×4 mm were produced using an injection molding machine as described in Example 1.

An MFR of the resin composition (3) as well as a dispersed particle diameter, a surface-to-surface interparticle distance, izod impact strength and weld strength of the injection-molded article produced were evaluated as described above. The injection-molded article produced had a matrix and domain structure where EVOH (A) is a matrix phase and the soft resin (B) is a domain phase. Physical properties of the resins used were shown in Tables 1 and 2 and the evaluation results were shown in Table 3.

Example 4

A resin composition (4) was prepared as described in Example 1, except that 80 parts by mass of EVOH (A1) was used as EVOH (A) and 10 parts by mass of MAh-EB(b1-2)("Tafmer MA8510" from Mitsui Chemicals, Inc.) and 10 parts by mass of EB (b2-2) ("Tafmer A4085" from Mitsui Chemicals, Inc.) were used as a soft resin (B). Next, an injection-molded article with a size of 80×10×4 mm and an injection-molded article having a weld line in its center with a size of 80×10×4 mm were produced using an injection molding machine as described in Example 1.

An MFR of the resin composition (4) as well as a dispersed particle diameter, a surface-to-surface interparticle distance, izod impact strength and weld strength of the injection-molded article produced were evaluated as described above. The injection-molded article produced had a matrix and domain structure where EVOH (A) is a matrix phase and the soft resin (B) is a domain phase. Physical properties of the resins used were shown in Tables 1 and 2 and the evaluation results were shown in Table 3.

Example 5

A resin composition (5) was prepared as described in Example 1, except that 80 parts by mass of EVOH (A1) was used as EVOH (A) and 5 parts by mass of MAh-EB (b1-2) ("Tafmer MA8510" from Mitsui Chemicals, Inc.) and 15 parts by mass of EB (b2-2) ("Tafmer A4085" from Mitsui Chemicals, Inc.) were used as a soft resin (B). Next, an injection-molded article with a size of 80×10×4 mm and an injection-molded article having a weld line in its center with a size of 80×10×4 mm were produced using an injection molding machine as described in Example 1.

An MFR of the resin composition (5) as well as a dispersed particle diameter, a surface-to-surface interparticle distance, izod impact strength and weld strength of the injection-molded article produced were evaluated as described above. The injection-molded article produced had a matrix and domain structure where EVOH (A) is a matrix phase and the soft resin (B) is a domain phase. Physical properties of the resins used were shown in Tables 1 and 2 and the evaluation results were shown in Table 3.

Example 6

A resin composition (6) was prepared as described in Example 1, except that 85 parts by mass of EVOH (A1) was used as EVOH (A) and 10 parts by mass of MAh-EB (b1-2) ("Tafmer MA8510" from Mitsui Chemicals, Inc.) and 5 parts by mass of EB (b2-2) ("Tafmer A4085" from Mitsui Chemicals, Inc.) were used as a soft resin (B). Next, an injection-molded article with a size of 80×10×4 mm and an injection-molded article having a weld line in its center with a size of 80×10×4 mm were produced using an injection molding machine as described in Example 1.

An MFR of the resin composition (6) prepared as well as a dispersed particle diameter, a surface-to-surface interparticle distance, izod impact strength and weld strength of the injection-molded article produced were evaluated as described above. The injection-molded article produced had a matrix and domain structure where EVOH (A) is a matrix phase and the soft resin (B) is a domain phase. Physical properties of the resins used were shown in Tables 1 and 2 and the evaluation results were shown in Table 3.

Example 7

A resin composition (7) was prepared as described in Example 1, except that 90 parts by mass of EVOH (A1) was used as EVOH (A) and 10 parts by mass of MAh-EB (b1-2) ("Tafmer MA8510" from Mitsui Chemicals, Inc.) was used as a soft resin (B). Next, an injection-molded article with a size of 80×10×4 mm and an injection-molded article having a weld line in its center with a size of 80×10×4 mm were produced using an injection molding machine as described in Example 1.

An MFR of the resin composition (7) as well as a dispersed particle diameter, a surface-to-surface interparticle distance, izod impact strength and weld strength of the injection-molded article produced were evaluated as described above. The injection-molded article produced had a matrix and domain structure where EVOH (A) is a matrix phase and the soft resin (B) is a domain phase. Physical properties of the resins used were shown in Tables 1 and 2 and the evaluation results were shown in Table 3.

Example 8

A resin composition (8) was prepared as described in Example 1, except that 80 parts by mass of EVOH (A1) was used as EVOH (A) and 10 parts by mass of MAh-EP (b1-3) (maleic-anhydride-modified ethylene-propylene copolymer) ("Tafmer MP0610" from Mitsui Chemicals, Inc.) and 10 parts by mass of EP (b2-3) (ethylene-propylene copolymer) ("Tafmer P0280" from Mitsui Chemicals, Inc.) were used as a soft resin (B). Next, an injection-molded article with a size of 80×10×4 mm and an injection-molded article having a weld line in its center with a size of 80×10×4 mm were produced using an injection molding machine as described in Example 1.

An MFR of the resin composition (8) as well as a dispersed particle diameter, a surface-to-surface interparticle distance, izod impact strength and weld strength of the injection-molded article produced were evaluated as described above. The injection-molded article produced had a matrix and domain structure where EVOH (A) is a matrix phase and the soft resin (B) is a domain phase. Physical properties of the resins used were shown in Tables 1 and 2 and the evaluation results were shown in Table 3.

Example 9

A resin composition (9) was prepared as described in Example 1, except that 80 parts by mass of EVOH (A1) was used as EVOH (A) and 10 parts by mass of MAh-SEBS (b1-4) (maleic-anhydride-modified styrene-ethylene/butylene-styrene block copolymer) ("Tuftec M1911" from Asahi Kasei Corporation) and 10 parts by mass of SEBS (b2-4) (styrene-ethylene/butylene-styrene block copolymer) ("Tuftec H1041" from Asahi Kasei Corporation) were used as a soft resin (B). Next, an injection-molded article with a size of 80×10×4 mm and an injection-molded article having a weld line in its center with a size of 80×10×4 mm were produced using an injection molding machine as described in Example 1.

An MFR of the resin composition (9) as well as a dispersed particle diameter, a surface-to-surface interparticle distance, izod impact strength and weld strength of the injection-molded article produced were evaluated as described above. The injection-molded article produced had a matrix and domain structure where EVOH (A) is a matrix phase and the soft resin (B) is a domain phase. Physical properties of the resins used were shown in Tables 1 and 2 and the evaluation results were shown in Table 3.

Comparative Example 1

An injection-molded article with a size of 80×10×4 mm and an injection-molded article having a weld line in its center with a size of 80×10×4 mm were produced by an injection molding machine as described in Example 1, using EVOH (A1) as EVOH (A) without a soft resin (B).

Izod impact strength and weld strength of the injection-molded article produced were evaluated as described above. Physical properties of the resins used were shown in Table 1 and the evaluation results are shown in Table 4.

Comparative Example 2

A resin composition (10) was prepared as described in Example 1, except that 95 parts by mass of EVOH (A1) was used as EVOH (A) and 5 parts by mass of MAh-EB(b1-2) ("Tafmer MA8510" from Mitsui Chemicals, Inc.) was used as a soft resin (B). Next, an injection-molded article with a size of 80×10×4 mm and an injection-molded article having a weld line in its center with a size of 80×10×4 mm were produced as described in Example 1, using an injection molding machine.

An MFR of the resin composition (10) as well as a dispersed particle diameter, a surface-to-surface interparticle distance, izod impact strength and weld strength of the injection-molded article produced were evaluated as described above. The injection-molded article produced had a matrix and domain structure where EVOH (A) is a matrix phase and the soft resin (B) is a domain phase. Physical properties of the resins used were shown in Tables 1 and 2 and the evaluation results were shown in Table 4.

Comparative Example 3

A resin composition (11) was prepared as described in Example 1, except that 90 parts by mass of EVOH (A1) was used as EVOH (A) and 10 parts by mass of EB (b2-2) ("Tafmer A4085" from Mitsui Chemicals, Inc.) was used as a soft resin (B). Next, an injection-molded article with a size of 80×10×4 mm and an injection-molded article having a weld line in its center with a size of 80×10×4 mm were produced as described in Example 1, using an injection molding machine.

An MFR of the resin composition (11) as well as a dispersed particle diameter, a surface-to-surface interparticle distance, izod impact strength and weld strength of the injection-molded article produced were evaluated as described above. The injection-molded article produced had a matrix and domain structure where EVOH (A) is a matrix phase and the soft resin (B) is a domain phase. Physical properties of the resins used were shown in Tables 1 and 2 and the evaluation results were shown in Table 4.

Comparative Example 4

A resin composition (12) was prepared as described in Example 1, except that 80 parts by mass of EVOH (A1) was used as EVOH (A) and 20 parts by mass of EB (b2-2) ("Tafmer A4085" from Mitsui Chemicals, Inc.) was used as a soft resin (B). Next, an injection-molded article with a size of 80×10×4 mm and an injection-molded article having a weld line in its center with a size of 80×10×4 mm were produced as described in Example 1, using an injection molding machine.

An MFR of the resin composition (12) as well as a dispersed particle diameter, a surface-to-surface interparticle distance, izod impact strength and weld strength of the injection-molded article produced were evaluated as described above. The injection-molded article produced had a matrix and domain structure where EVOH (A) is a matrix phase and the soft resin (B) is a domain phase. Physical properties of the resins used were shown in Tables 1 and 2 and the evaluation results were shown in Table 4.

Comparative Example 5

A resin composition (13) was prepared as described in Example 1, except that 80 parts by mass of EVOH (A1) was used as EVOH (A) and 1 part by mass of MAh-EB (b1-2) ("Tafmer MA8510" from Mitsui Chemicals, Inc.) and 19 parts by mass of EB (b2-2) ("Tafmer A4085" from Mitsui Chemicals, Inc.) were used as a soft resin (B). Next, an injection-molded article with a size of 80×10×4 mm and an injection-molded article having a weld line in its center with a size of 80×10×4 mm were produced as described in Example 1, using an injection molding machine.

An MFR of the resin composition (13) as well as a dispersed particle diameter, a surface-to-surface interparticle distance, izod impact strength and weld strength of the injection-molded article produced were evaluated as described above. The injection-molded article produced had a matrix and domain structure where EVOH (A) is a matrix phase and the soft resin (B) is a domain phase. Physical properties of the resins used were shown in Tables 1 and 2 and the evaluation results were shown in Table 4.

Comparative Example 6

A resin composition (14) was prepared as described in Example 1, except that 70 parts by mass of EVOH (A1) was used as EVOH (A) and 10 parts by mass of MAh-EB (b1-2) ("Tafmer MA8510" from Mitsui Chemicals, Inc.) and 20 parts by mass of EB (b2-2) ("Tafmer A4085" from Mitsui Chemicals, Inc.) were used as a soft resin (B). Next, an injection-molded article with a size of 80×10×4 mm and an injection-molded article having a weld line in its center with a size of 80×10×4 mm were produced as described in Example 1, using an injection molding machine.

An MFR of the resin composition (14) as well as a dispersed particle diameter, a surface-to-surface interparticle distance, izod impact strength and weld strength of the injection-molded article produced were evaluated as described above. The injection-molded article produced had a matrix and domain structure where EVOH (A) is a matrix phase and the soft resin (B) is a domain phase. Physical properties of the resins used were shown in Tables 1 and 2 and the evaluation results were shown in Table 4.

Comparative Example 7

A resin composition (15) was prepared as described in Example 1, except that 90 parts by mass of EVOH (A1) was used as EVOH (A) and 10 parts by mass of MAh-TPEE (b1-5) (maleic-anhydride-modified thermoplastic polyester elastomer) which is a polymer having polyalkylene ether units described in Japanese published unexamined application No. 2010-95315 was used as a soft resin (B). Next, an injection-molded article with a size of 80×10×4 mm and an injection-molded article having a weld line in its center with a size of 80×10×4 mm were produced as described in Example 1, using an injection molding machine.

An MFR of the resin composition (15) as well as a dispersed particle diameter, a surface-to-surface interparticle distance, izod impact strength and weld strength of the injection-molded article produced were evaluated as described above. The injection-molded article produced had a matrix and domain structure where EVOH (A) is a matrix phase and the soft resin (B) is a domain phase. Physical properties of the resins used were shown in Tables 1 and 2 and the evaluation results were shown in Table 4.

TABLE 1

| | | Ethylene content (mol %) | Saponification degree (mol %) | MFR 210° C./ 2160 g (g/10 min) | Density (g/cm$^3$) |
|---|---|---|---|---|---|
| EVOH (A) | (A1) | 32 | >99 | 3.7 | 1.19 |
| | (A2) | 27 | >99 | 4.0 | 1.20 |

TABLE 2

| | | | MFR 210° C./ 2160 g (g/10 min) | Durometer type A hardness | Acid value (mgKOH/g) | Density (g/cm$^3$) |
|---|---|---|---|---|---|---|
| Soft resin (B) | Acid-modified soft resin (b1) | MAh-EB (b1-1) | 1.3 | 73 | 6.5 | 0.870 |
| | | MAh-EB (b1-2) | 2.9 | 86 | 5.5 | 0.885 |
| | | MAh-EP (b1-3) | 0.7 | 65 | 6.1 | 0.870 |
| | | MAh-SEBS (b1-4) | 1.9 | 84 | 1.9 | 0.91 |
| | | MAh-TPEE (b1-5) | 32.2 | 92 | 10.5 | 1.12 |
| | Unmodified soft resin (b2) | EB (b2-1) | 1.3 | 73 | — | 0.864 |
| | | EB (b2-2) | 2.9 | 86 | — | 0.885 |
| | | EP (b2-3) | 5.4 | 68 | — | 0.869 |
| | | SEBS (b2-4) | 1.8 | 84 | — | 0.91 |

TABLE 3

| | | | Example 1 | Example 2 | Example 3 | Example 4 | Example 5 | Example 6 | Example 7 | Example 8 | Example 9 |
|---|---|---|---|---|---|---|---|---|---|---|---|
| Composition | EVOH (A) | (A1) | 80 | — | 80 | 80 | 80 | 85 | 90 | 80 | 80 |
| | | (A2) | — | 80 | — | — | — | — | — | — | — |
| | Soft resin (B) Acid-modified soft resin (b1) | (b1-1) | 10 | 10 | — | — | — | — | — | — | — |
| | | (b1-2) | — | — | 20 | 10 | 5 | 10 | 10 | — | — |
| | | (b1-3) | — | — | — | — | — | — | — | 10 | — |
| | | (b1-4) | — | — | — | — | — | — | — | — | 10 |
| | | (b1-5) | — | — | — | — | — | — | — | — | — |
| | Unmodified soft resin (b2) | (b2-1) | 10 | 10 | — | — | — | — | — | — | — |
| | | (b2-2) | — | — | — | 10 | 15 | 5 | — | — | — |
| | | (b2-3) | — | — | — | — | — | — | — | 10 | — |
| | | (b2-4) | — | — | — | — | — | — | — | — | 10 |
| | Blend ratio (A)/(B) | | 80/20 | 80/20 | 80/20 | 80/20 | 80/20 | 85/15 | 90/10 | 80/20 | 80/20 |
| | Durometer type A hardness of (B) | | 64 | 64 | 86 | 86 | 86 | 86 | 86 | 67 | 84 |
| Evaluation | MFR 210° C./2160 g (g/10 min) | | 1.0 | 1.2 | 1.0 | 1.0 | 1.3 | 1.5 | 2.1 | 0.9 | 1.1 |
| | Dispersed particle diameter (μm) | | 0.33 | 0.33 | 0.32 | 0.32 | 0.37 | 0.28 | 0.28 | 0.35 | 0.37 |
| | Surface-to-surface interparticle distance (μm) | | 0.14 | 0.14 | 0.14 | 0.14 | 0.16 | 0.16 | 0.22 | 0.15 | 0.16 |
| | Izod impact strength (23° C.) (kJ/m$^2$) | | 97.0 | 96.4 | 84.3 | 74.1 | 74.0 | 67.0 | 16.1 | 93.1 | 52.0 |
| | Izod impact strength (−20° C.) (kJ/m$^2$) | | 23.3 | 23.5 | 15.1 | 12.6 | 11.2 | 14.6 | 9.0 | 19.0 | 10.6 |
| | Weld strength (kJ/m$^2$) | | 57.3 | 56.3 | 54.8 | 48.3 | 49.3 | 58.3 | 129.0 | 45.8 | 49.2 |

TABLE 4

| | | | Comparative Example 1 | Comparative Example 2 | Comparative Example 3 | Comparative Example 4 | Comparative Example 5 | Comparative Example 6 | Comparative Example 7 |
|---|---|---|---|---|---|---|---|---|---|
| Composition | EVOH (A) | (A1) | 100 | 95 | 90 | 80 | 80 | 70 | 90 |
| | | (A2) | — | — | — | — | — | — | — |
| | Soft resin (B) Acid-modified soft resin (b1) | (b1-1) | — | — | — | — | — | — | — |
| | | (b1-2) | — | 5 | — | — | 1 | 10 | — |
| | | (b1-3) | — | — | — | — | — | — | — |
| | | (b1-4) | — | — | — | — | — | — | — |
| | | (b1-5) | — | — | — | — | — | — | 10 |
| | Unmodified soft resin (b2) | (b2-1) | — | — | — | — | — | — | — |
| | | (b2-2) | — | — | 10 | 20 | 19 | 20 | — |
| | | (b2-3) | — | — | — | — | — | — | — |
| | | (b2-4) | — | — | — | — | — | — | — |
| | Blend ratio (A)/(B) | | 100/0 | 95/5 | 90/10 | 80/20 | 80/20 | 70/30 | 90/10 |
| | Durometer type A hardness of (B) | | — | 86 | 86 | 86 | 86 | 86 | 92 |
| Evaluation | MFR 210° C./2160 g (g/10 min) | | 3.7 | 3.0 | 3.7 | 4.2 | 2.6 | 0.2 | 2.7 |
| | Dispersed particle diameter (μm) | | — | 0.26 | 0.66 | 2.07 | 0.72 | 0.49 | 0.29 |
| | Surface-to-surface interparticle distance (μm) | | — | 0.32 | 0.52 | 0.90 | 0.31 | 0.13 | 0.26 |

TABLE 4-continued

| | Comparative Example 1 | Comparative Example 2 | Comparative Example 3 | Comparative Example 4 | Comparative Example 5 | Comparative Example 6 | Comparative Example 7 |
|---|---|---|---|---|---|---|---|
| Izod impact strength (23° C.) ($kJ/m^2$) | 4.1 | 6.5 | 8.2 | 4.7 | 7.7 | 70.5 | 11.3 |
| Izod impact strength (−20° C.) ($kJ/m^2$) | 3.3 | 3.5 | 3.7 | 3.0 | 5.5 | 12.2 | 7.7 |
| Weld strength ($kJ/m^2$) | 141.7 | 137.5 | 1.6 | 1.5 | 1.7 | 3.4 | 29.0 |

The examples described above show that the resin composition exhibits excellent izod impact strength at a low temperature and room temperature, and furthermore exhibits excellent weld strength. Thus, such a layer of resin composition as an innermost layer can be used to provide a blow-molded container which is excellent in impact strength of the side, the bottom and the edge and impact strength of the pinch-off part.

In contrast, in Comparative Example 1, EVOH (A) alone has lower izod impact strength, and therefore, a blow-molded container produced using EVOH (A) alone exhibits insufficient impact strength of the side, the bottom and the edge.

Even in a resin composition containing EVOH (A) and a soft resin (B) as described in Comparative Example 2, a mass ratio of EVOH (A) to the soft resin (B) [(A)/(B)] is beyond the range of 75/25 to 90/10. When a proportion of EVOH (A) is higher, izod impact strength is reduced and a blow-molded container produced using the resin composition, therefore, exhibits insufficient impact strength of the side, the bottom and the edge.

As seen in Comparative Examples 3, 4 and 5, when a surface-to-surface interparticle distance in a dispersed phase is more than 0.3 μm, even a resin composition containing EVOH (A) and a soft resin (B) in which a mass ratio of EVOH (A) to the soft resin (B) [(A)/(B)] is within the range of 75/25 to 90/10, has lower izod impact strength and weld strength, and a blow-molded container produced using such a resin composition, therefore, exhibits insufficient impact strength of the side, the bottom and the edge and impact strength of the pinch-off part.

As seen in Comparative Example 6, when a mass ratio of EVOH (A) to a soft resin (B) [ (A)/(B)] is beyond the range of 75/25 to 90/10 and the soft resin (B) is excessive, even a resin composition containing EVOH (A) and the soft resin (B) in which a surface-to-surface interparticle distance in a dispersed phase is 0.3 μm or less exhibits higher izod impact strength but lower weld strength at a low temperature and room temperature, and, therefore, in a blow-molded container produced using such a resin composition, a pinch-off part exhibits insufficient impact strength.

As seen in Comparative Example 7, when the soft resin (B) is not a thermoplastic styrenic elastomer or α-olefinic polymer, even a resin composition containing EVOH (A) and the soft resin (B) in which a mass ratio of EVOH (A) to the soft resin (B) [(A)/(B)] is within the range of 75/25 to 90/10 and a surface-to-surface interparticle distance in a dispersed phase is 0.3 μm or less exhibits sufficient izod impact strength, but low weld strength, and, therefore, in a blow-molded container produced using such a resin composition, a pinch-off part exhibits insufficient impact strength.

Example 10

A blow-molded container having a pinch-off part with a layer structure (the left side represents an inner layer): resin composition (1)/Tie/PP=115 μm/40 μm/690 μm, volume: 1000 mL, surface area: 680 $cm^2$ was produced using the resin composition (1) of Example 1 as a resin composition, "NOVATEC-PP EA7A" from Japan Polypropylene Corporation as polypropylene (PP) and "Admer QF500" from Mitsui Chemicals, Inc. as an adhesive resin (Tie). Ethylene glycol was injected to 98% volume of the blow-molded container produced, and then cooled to −18° C. The blow-molded container after cooling was subjected to a horizontal drop test where a sample was dropped from the height of 1.2 m such that a side became an impact point and a diagonal drop test where a sample was dropped such that an edge became an impact point. As a result, in these tests, no cracks were observed in the container and liquid leakage did not occur.

Comparative Example 8

A blow-molded container having a pinch-off part with a layer structure (the left side represents an inner layer): EVOH (A1)/Tie/PP=115 μm/40 μm/690 μm, volume: 1000 mL, surface area: 680 $cm^2$ was produced using EVOH (A1), "NOVATEC-PP EA7A" from Japan Polypropylene Corporation as polypropylene (PP) and "Admer QF500" from Mitsui Chemicals, Inc. as an adhesive resin (Tie). Ethylene glycol was injected to 98% volume of the blow-molded container produced, and then cooled to −18° C. The blow-molded container after cooling was subjected to a horizontal drop test and a diagonal drop test as described in Example 10. As a result, cracks were observed in the side in the horizontal drop test and in the edge in the diagonal drop test, and liquid leakage occurred.

Comparative Example 9

A blow-molded container having a pinch-off part with a layer structure (the left side represents an inner layer): resin composition (14)/Tie/PP=115 μm/40 μm/690 μm, volume: 1000 mL, surface area: 680 $cm^2$ was produced using the resin composition (14) of Comparative Example 6 as a resin composition, "NOVATEC-PP EA7A" from Japan Polypropylene Corporation as polypropylene (PP) and "Admer QF500" from Mitsui Chemicals, Inc. as an adhesive resin (Tie). Ethylene glycol was injected to 98% volume of the blow-molded container produced, and then cooled to −18° C. The blow-molded container after cooling was subjected to a horizontal drop test and a diagonal drop test as described in Example 10. As a result, cracks were observed in the pinch-off part in both tests, and liquid leakage occurred.

The invention claimed is:

1. A blow-molded container, comprising a pinch-off part and as an innermost layer, a layer of resin composition, the resin therein consisting of an ethylene-vinyl alcohol copolymer (A) and a soft resin (B), wherein the soft resin (B) is a thermoplastic styrenic elastomer or α-olefinic polymer;

a mass ratio of the ethylene-vinyl alcohol copolymer (A) to the soft resin (B) [(A)/(B)] ranges from 80/20 to 90/10;

the resin composition has a matrix and domain structure in which the ethylene-vinyl alcohol copolymer (A) is a matrix phase and the soft resin (B) is a domain phase;

a surface-to-surface interparticle distance in the domain phase is 0.3 μm or less;

a melt flow rate of the resin composition measured under a load of 2160 g at 210° C. is ⅕ or more and ⅔ or less of a melt flow rate of the ethylene-vinyl alcohol copolymer (A); and a melt flow rate of the soft resin (B) measured under a load of 2160 g at 210° C. is 1.0 to 100 g/10 min.

2. The container as claimed in claim 1, wherein the soft resin (B) is a mixture of an acid-modified soft resin (b1) and an unmodified soft resin (b2).

3. The container as claimed in claim 1, wherein a hardness of the soft resin (B) as measured by a durometer type A in accordance with ISO 7619 is 90 or less.

4. The container as claimed in claim 1, which is a chemical bottle.

5. The container as claimed in claim 4, wherein the chemical bottle is an agrochemical bottle.

6. The container as claimed in claim 1, wherein the layer of the resin composition has a thickness of from 10 to 500 μm.

7. The container as claimed in claim 1, wherein, as the innermost layer, the layer of the resin composition consists of the ethylene-vinyl alcohol copolymer (A) and the soft resin (B).

* * * * *